US011654940B2

(12) United States Patent
Evans

(10) Patent No.: US 11,654,940 B2
(45) Date of Patent: May 23, 2023

(54) STOP FOR A RAIL

(71) Applicant: Castree Projects Limited, Chester (GB)

(72) Inventor: David Nicholas Evans, Chester (GB)

(73) Assignee: Castree Projects Limited, Chester (GB)

( * ) Notice: Subject to any disclaimer, the term of this patent is extended or adjusted under 35 U.S.C. 154(b) by 629 days.

(21) Appl. No.: 16/787,538

(22) Filed: Feb. 11, 2020

(65) Prior Publication Data

US 2020/0255036 A1 Aug. 13, 2020

(30) Foreign Application Priority Data

Feb. 11, 2019 (GB) ..... 1901884

(51) Int. Cl.

| | |
|---|---|
| ***B61B 12/02*** | (2006.01) |
| ***A63G 21/22*** | (2006.01) |
| ***B61B 7/00*** | (2006.01) |
| ***B61K 7/16*** | (2006.01) |
| *A63G 21/20* | (2006.01) |

(52) U.S. Cl.

CPC ..... *B61B 12/022* (2013.01); *A63G 21/22* (2013.01); *B61B 7/00* (2013.01); *B61K 7/16* (2013.01); *A63G 21/20* (2013.01)

(58) Field of Classification Search

CPC ..... B61B 12/022; B61B 7/00; B61B 3/00; B61B 13/04; A63G 21/20; A63G 21/22; B65G 9/00; B65G 9/006

See application file for complete search history.

(56) References Cited

U.S. PATENT DOCUMENTS

| | | | | |
|---|---|---|---|---|
| 1,489,105 | A | 4/1924 | Armington | |
| 2015/0021147 | A1 | 1/2015 | Ihrefors | |
| 2018/0272172 | A1* | 9/2018 | Browning, Jr. | A63G 21/22 |
| 2020/0062284 | A1* | 2/2020 | Evans | B61B 3/00 |
| 2020/0197823 | A1* | 6/2020 | Browning, Jr. | A63G 21/22 |

FOREIGN PATENT DOCUMENTS

| | | | |
|---|---|---|---|
| KR | 101793201 | B1 | 11/2017 |
| WO | 9622821 | A1 | 8/1996 |

OTHER PUBLICATIONS

EP Extended Search Report for Application No. 20156259.2, dated Jul. 3, 2020, 8 pages.

Great Britain Search and Examination Report for Application No. GB1901884.5, dated Jul. 30, 2019, 7 pages.

* cited by examiner

*Primary Examiner* — Zachary L Kuhfuss

(74) *Attorney, Agent, or Firm* — Hoffman Warnick LLC

(57) ABSTRACT

A stop for stopping a trolley on a rail is described. The trolley comprises a set of wheels, including a first wheel and the rail provides, at least in part, a running surface, including a first portion and a second portion thereof, for the first wheel. The stop comprises an actuator providing a third portion of the running surface between the first portion and the second portion and an arm, coupled to the actuator. The stop is arrangeable in a first configuration, wherein the arm is arranged to block the trolley therepast. The stop is arrangeable in a second configuration, wherein the arm is arranged to allow the trolley therepast. The stop is arranged to move from the first configuration to the second configuration by actuation of the actuator, preferably by a movement of the actuator in a direction transverse to the third portion of the running surface.

17 Claims, 11 Drawing Sheets

STOP FOR A RAIL

FIELD

The present invention relates to stops for rails, for example for stopping a trolley on a rail.

BACKGROUND TO THE INVENTION

Typically, a zipline (also known as a zip-line, zip wire, aerial runway or aerial ropeslide) comprises an inclined cable, secured only at upper and lower ends thereof, and a trolley (also known as a bogey or carriage), including a freely-rolling pulley. A user (i.e. a load), suspended from the trolley, may be accelerated by gravity from the upper end to the lower end of the inclined cable. In use, the pulley rolls along an uppermost portion of the inclined cable. A gradient of the inclined cable is typically in a range from 1 in 20 to 1 in 30. Usually, the inclined cable sags and appropriate tensioning of the inclined cable is required to control acceleration of the user. Since the inclined cable is secured only at the upper and the lower ends thereof, the inclined cable is restricted to a linear path, without lateral deviations, such as curves or bends.

To provide a non-linear path including lateral deviations, such as curves or bends, the cable may be replaced with a rail, typically a monorail. The non-linear path enables the rail to curve around obstacles, for example, and/or to increase user enjoyment. An uppermost portion of the rail may be fixed to a framework or hung from ceiling joists or trees, for example, such that a region under the rail remains unobstructed for the trolley and the user to travel through. That is, the rail is a suspended rail, situated at a height typically in a range from 2 m to 10 m, above the ground. A typical rail includes a tube having an axial (also known as longitudinal) flange, for fixing or hanging, upstanding therefrom. The pulley is replaced by one or more freely-rolling wheels, that roll along the rail on an upper lateral portion or portions thereof, clear of the fixed uppermost portion. For example, the wheels may roll either side of the axial flange. For safety, the trolley is arranged to be captive on the rail, such that the trolley (i.e. a captive trolley) remains on the rail, in use. Two or more trolleys may be captive on the rail, such that two or more respective users may travel thereon. The rail is generally inclined, having a mean gradient typically in a range from 1 in 10 to 1 in 60, though may include one or more descending portions, ascending portions and/or horizontal portions. A total length of the rail may be in excess of 500 m, including multiple curves or bends, descending portions, ascending portions and/or horizontal portions. An installed rail may be known as a rail track. The rail may be a continuous (also known as an endless) rail, forming a closed rail track.

Typically, the user is suspended from the trolley in a prone position via a harness that is attached to the trolley, for example releasably clipped to the trolley such as using a screw lock carabiner. Typically, the trolley also includes handles, which may be rigid or flexible, for the user to hold, in use. Generally, the user puts on the harness in advance of a zipline ride, queues for the zipline ride on a platform near the start of the zipline ride and the user's harness is attached to the trolley. The user then holds onto the handles and jumps off the end of the platform, that may be at a height of about 10 m or more, for the zipline ride.

However, a problem arises in that the user's harness may not be attached to the trolley at the start of the zipline ride, for example due to zipline operator error or user overenthusiasm. Instead, the user may simply hold on to the handles and jump off the platform, without the user's harness attached to the trolley. Unable to support their own weight when holding the handles, the user may fall from the zipline ride, resulting in injury to the user.

Hence, there is a need to improve rails and/or trolleys, for example to improve user safety.

SUMMARY OF THE INVENTION

It is one aim of the present invention, amongst others, to provide a stop for stopping a trolley, a stop assembly, a rail track, a trolley assembly and a trolley which at least partially obviates or mitigates at least some of the disadvantages of the prior art, whether identified herein or elsewhere. In this way, user safety may be improved.

A first aspect provides a stop for stopping a trolley on a rail, the trolley comprising a set of wheels, including a first wheel, the rail providing, at least in part, a running surface, including a first portion and a second portion thereof, for the first wheel, the stop comprising:

an actuator providing a third portion of the running surface between the first portion and the second portion; and an arm, coupled to the actuator;

wherein the stop is arrangeable in:

a first configuration, wherein the arm is arranged to block the trolley therepast; and a second configuration, wherein the arm is arranged to allow the trolley therepast;

wherein the stop is arranged to move from the first configuration to the second configuration by actuation of the actuator, preferably by a movement of the actuator in a direction transverse to the third portion of the running surface.

A second aspect provides a stop assembly comprising a stop according to the first aspect and a section of rail for a trolley comprising a set of wheels, including a first wheel, the rail providing, at least in part, a running surface, including a first portion and a second portion thereof, for the first wheel.

A third aspect provides a rail track, or a kit of parts for a rail track, comprising a set of rails and a stop according to the first aspect or a stop assembly according to the second aspect.

A fourth aspect provides a trolley assembly comprising:

a stop assembly according to the second aspect; and a trolley comprising a frame, a set of wheels, including a first wheel, rotatably coupled to the frame; and an attachment member, coupled to the frame, for attachment, preferably suspension, of a load therefrom, in use.

A fifth aspect provides a trolley for a rail providing a running surface for a wheel, the trolley comprising:

a frame;

a set of wheels, including a first wheel and optionally a second wheel, rotatably coupled to the frame; and an attachment member, coupled to the frame, for attachment, preferably suspension, of a load therefrom, in use.

DETAILED DESCRIPTION OF THE INVENTION

According to the present invention there is provided a stop for stopping a trolley, as set forth in the appended claims. Also provided are a stop assembly, a rail track, a trolley assembly and a trolley. Other features of the invention will be apparent from the dependent claims, and the description that follows.

Stop

The first aspect provides a stop for stopping a trolley on a rail, the trolley comprising a set of wheels, including a first wheel, the rail providing, at least in part, a running surface, including a first portion and a second portion thereof, for the first wheel, the stop comprising:

an actuator providing a third portion of the running surface between the first portion and the second portion; and an arm, coupled to the actuator;

wherein the stop is arrangeable in:

a first configuration, wherein the arm is arranged to block the trolley therepast; and a second configuration, wherein the arm is arranged to allow the trolley therepast;

wherein the stop is arranged to move from the first configuration to the second configuration by actuation of the actuator, preferably by a movement of the actuator in a direction transverse to the third portion of the running surface.

Hence, in the first configuration, the arm blocks the trolley, thereby stopping (i.e. blocking, obstructing, impeding, preventing, denying) the trolley from running beyond the stop on the rail. The first configuration may be known as a closed configuration. That is, in the first configuration, the stops acts as a barrier, for example a safety barrier, that constrains the trolley to that section of the rail before the stop. In this way, a user is prevented from pushing or pulling the trolley along the rail beyond the stop, for example by applying a force on the trolley in a direction along the rail or along the running surface. In this way, a likelihood of the user jumping off the end of a platform for a zipline ride the trolley is reduced, for example, because the trolley is blocked by the stop before the end of the platform. In one example, the first configuration is a default configuration of the stop. In this way, trolleys are blocked by default by the stop. That is, the stop is normally closed.

In contrast, in the second configuration, the arm does not block the trolley (i.e. not (i.e. blocking, not obstructing, not impeding, not preventing, not denying), thereby allowing the trolley to run beyond the stop on the rail. The second configuration may be known as an open configuration. That is, the stop acts a releasable barrier, that selectively allows (i.e. permits, lets, frees) the trolley to run beyond the stop on the rail. Moving of the stop from the first configuration to the second configuration is by the actuation of the actuator, preferably by the movement of the actuator in the direction transverse to the third portion of the running surface. That is, this actuation of the actuator, for example the movement of the actuator, controls opening (i.e. releasing) the stop. Preferably, the movement of the actuator to move the stop from the first configuration to the second configuration is transverse to the third portion of the running surface provided by the actuator. That is, the movement is transverse to the direction along the rail or the running surface and hence transverse to the direction in which the user would attempt to push or pull the trolley along the rail beyond the stop. In other words, pushing or pulling the trolley along the rail will not open the stop. Rather, in order to open the stop (i.e. move the stop from the first configuration to the second configuration), the actuator is actuated, preferably moved transversely to the third portion and hence transversely to a direction in which the user is pulling or pushing the trolley along the rail. In one example, the actuator is actuated, preferably moved, only transversely to the direction in which the user is pulling or pushing the trolley along the rail. Furthermore, the actuator provides the third portion of the running surface between the first portion and the second portion of the running surface for the first wheel of the trolley. Hence, the movement of the actuator may be due, at least in part, to a force imposed thereupon through the first wheel, as described below in more detail. The force may arise from suspension of the user from the trolley, via the user's harness attached to the trolley, such that the stop will open (i.e. move from the second configuration to the first configuration) only if the user is suspended from the trolley, rather than the user merely attempting to push or pull the trolley along the rail beyond the stop. In this way, safety is improved since the user may only move the trolley beyond the stop if suspended therefrom.

The stop may also be known as a train stop, a trip stop, a tripcock or a tripper. However, a conventional train stop typically operates in a normally open configuration and is selectively closed according to a signal, for example, such that braking is applied to a train. In contrast, the stop according to the first aspect is normally closed and is selectively opened according to the movement of the actuator in the direction transverse to the third portion of the running surface, for the first wheel Trolley The trolley comprising a set of wheels, including the first wheel. The trolley may be as described below with respect to the fifth aspect.

Rail

The rail provides, at least in part, the running surface, including the first portion and the second portion thereof, for the first wheel. Furthermore, other rails and/or rail sections included in a rail track may also be as described below, mutatis mutandis.

It should be understood that in use, the first wheel rolls on the running surface, along the rail. In one example, the first portion and the second portion of the rail are similar, substantially similar and/or identical, for example having similar, substantially similar and/or identical cross-sectional shapes and/or profiles. In one example, the first portion and the second portion of the running surface are aligned such that the running surface provided by the first portion and the second portion is continuous thereacross. In one example, the first portion and the second portion of the running surface are transversely thereto mutually offset. That is, a step may be provided between the first portion and the second portion such that the running surface provided by the first portion and the second portion is discontinuous thereacross.

In one example, the rail comprises a planar (i.e. a flat) running surface, for example provided by a square or rectangular bar or hollow section and/or by an equal or unequal angle section. In one example, the rail comprises a non-planar, for example a convex or a concave running surface. In one example, the rail comprises a cylindrical (i.e. a convex) running surface defining a cylinder axis, wherein the line is substantially coincident, in use, with the cylinder axis, for example provided by a tube (i.e. a section) having a circular cross-section or a part thereof, such as a U shape channel. Hollow section is preferred, reducing a weight of the rail. In one example, the tube has an external diameter $D_{ext}$ in a range from 40 mm to 100 mm, preferably in a range from 50 mm to 75 mm, for example 60.3 mm. In one example, the tube has a wall thickness in a range from 1 mm to 6 mm, preferably in a range from 2 mm to 5 mm, for example 3 mm or 4 mm, for example 3.2 mm. In one example, the tube has an internal diameter $D_{int}$ in a range from 35 mm to 95 mm, preferably in a range from 45 mm to 70 mm.

In one example, the rail comprises a non-linear, for example a curved, portion. In this way, the non-linear portion enables the rail to curve around obstacles, for example, and/or to increase user enjoyment, as described above. It should be understood that the non-linear portion is generally sideways (i.e. transverse to a general direction of travel of a trolley), though the rail may curve sideways and up or down also.

In one example, the rail comprises two or more rails, for example two parallel rails. In one example, the rail is a monorail (i.e. a single rail). A monorail is preferred, reducing cost and/or weight, may be fixed readily to a framework or hung from ceiling joists or trees, for example, and/or may be formed into relatively complex shapes, including multiple non-linear and linear portions that may also ascend, descend and/or be horizontal.

In one example, the rail is formed from steel according to EN 10025: part 2: 2004 grade S185, S235, S275, S355 or equivalent. In one example, the tube is seamless tube, for example cold-rolled seamless tube. In one example, the rail is coated, for example powder coated, painted and/or galvanized, to improve corrosion resistance. Generally, the stop may be formed from such steel and/or coated similarly.

In one example, the rail comprises a flange. The flange (also known as a web or a stiffener) increases a stiffness of the rail, for example a resistance to bending of the rail. In one example, the running surface comprises a planar running surface and/or a non-planar running surface, for example a concave running surface or a convex running surface. In one example, the running surface comprises a cylindrical running surface or a part thereof. In one example, the rail comprises a cylindrical tube, wherein the running surface comprises a cylindrical running surface or a part thereof and wherein the rail comprises a flange.

In this way, relatively complex non-linear paths may be provided, including lateral deviations, such as curves or bends, and/or one or more descending portions, ascending portions and/or horizontal portions, for example by forming, such as bending or rolling the tube. Furthermore, since the tube has cylindrical symmetry, a transverse curvature of the running surface is relatively invariant, including for relatively complex non-linear paths, thereby providing a more continuous running surface.

In one example, the flange is arranged upstanding from the tube i.e. extending away therefrom. In one example, the flange is arranged longitudinally with respect to the tube. In one example, the flange is oriented normally to the running surface. In one example, the rail comprises a longitudinal flange. In one example, the flange is arranged to provide a fixing means, for example a lifting eye or a perforation or a set thereof through the flange, for suspension of the rail therefrom. Other fixing means are known. In this way, the rail may be fixed to, for example suspended from, a framework or hung from ceiling joists or trees, for example, such that a region under the rail remains unobstructed for the trolley and the user to travel through. In one example, the longitudinal flange comprises a first set of perforations for suspension. In one example, the longitudinal flange comprises a second set of perforations, congruent with a set of perforations provided in a third part of the rail coupling. In one example, the longitudinal flange extends continuously along a length of the rail. In one example, the flange is welded to the tube, for example continuously or intermittently (i.e. stitch welding, for example on alternate sides of the flange).

In one preferred example, the rail comprises a cylindrical tube, wherein the running surface comprises a cylindrical running surface or a part thereof and wherein the rail comprises a longitudinal flange normal to the tube (i.e. upstanding therefrom) extending continuously along the tube.

In one example, a length of the flange is greater than a length of the tube. For example, the flange may extend beyond one or both ends of the tube. In one example, the flange extends beyond both ends of the tube, by distances correlating or coinciding (i.e. equal to or substantially equal to) respective lengths, or parts thereof, of the third portion of the running surface provided by the first part and/or the second part of the rail coupling joined thereto.

Actuator

The stop comprises the actuator providing a third portion of the running surface between the first portion and the second portion. It should be understood that the actuator is thus arranged between the first portion and the second portion of the running surface provided by the rail, for example arranged longitudinally along an axis of the rail. That is, the third portion of the running surface provided by the actuator is contiguous with the first portion and the second portion of the running surface provided by the rail. Thus, in use, the first wheel may roll on the first portion and the second portion via the third portion, for example, and/or vice versa.

In one example, the first portion and the second portion of the running surface are transversely thereto mutually offset, for example by an offset in a range from 1 mm to 20 mm, preferably in a range from 2 mm to 10 mm, more preferably in a range from 3 mm to 7 mm, for example 4, 5 or 6 mm. That is, a step may be provided between the first portion and the second portion such that the running surface provided by the first portion and the second portion is discontinuous thereacross, for example not continuous but may be parallel while not coplanar. In one example, the movement of the actuator, providing the third portion of the running surface, corresponds to the step. In this way, the first wheel may run from the first portion onto the third portion, for example continuously, the actuator moved by the movement and the first wheel subsequently run from the third portion onto the second portion, for example continuously, for example contiguous and/or coplanar. In one example, in the first configuration, the first portion and the third portion of the running surface are aligned such that the running surface provided by the first portion and the third portion is continuous thereacross. In one example, in the first configuration, the second portion and the third portion of the running surface are transversely thereto mutually offset such that the running surface provided by the second portion and the third portion is discontinuous thereacross. In one example, in the second configuration, the second portion and the third portion of the running surface are aligned such that the running surface provided by the second portion and the third portion is continuous thereacross. In one example, in the second configuration, the first portion and the third portion of the running surface are transversely thereto mutually offset such that the running surface provided by the first portion and the third portion is discontinuous thereacross.

In one example, the actuator comprises and/or is a pressure sensor, a contact sensor and/or a push button. Hence, actuation of the actuator may be by pressure (i.e. a load) on the pressure sensor, contact (e.g. closing of an electrical circuit) of the contact sensor and/or depression of the push button respectively.

In one example, the actuator is provided in a recess in the rail, for example in a slot (i.e. a closed hole) or a perforation (i.e. an open hole), such that the actuator is surrounded, for example substantially and/or entirely, surrounded by the running surface provided by the rail. In one example, the actuator is provided as a button, such as a push-button, in the rail. In one example, the actuator is arranged to separate the first portion and the second portion of the running surface provided by the rail, for example longitudinally or axially. In one example, the first portion and the second portion of the running surface provided by the rail are spaced apart by the actuator, for example longitudinally or axially. In one example, the third portion of the running surface provided by actuator is similar to and/or the same as (i.e. by cross-sectional shape and/or profile) the first portion and/or the second portion of the running surface provided by the rail.

In one example, an axial length of the actuator is at most a length of the trolley, preferably a wheelbase of the trolley. In one example, an axial length of the actuator is in a range from 0.25 D to a 2D, preferable 0.5 D to 1.5 D, more preferably from 0.75 D to 1.25 D, wherein D is the diameter of the first wheel. Typically, the diameter D of the first wheel is in a range from 25 mm to 100 mm, preferably in a range from 50 mm to 75 mm, for example 61 mm. In one example, an axial length of the actuator is in a range from 25 mm to 100 mm, preferably in a range from 50 mm to 75 mm, for example 61 mm. In this way, the axial length of the actuator corresponds with the diameter of the first wheel such that only one wheel of the set of wheels contacts the actuator at a given time. In this way, the movement of the actuator may be due, at least in part, to a force imposed thereupon through only the first wheel. In one example, the set of wheels includes a second wheel, spaced axially from the first wheel, wherein, in use, the first wheel and the second wheel are arrangeable on the first portion and the third portion, respectively, of the running surface and/or wherein the first wheel and the second wheel are arrangeable on the third portion and the second portion, respectively, of the running surface. In this way, the movement of the actuator may be due, at least in part, to a moment imposed thereupon through only the first wheel about the second wheel.

In one example, an axial spacing between the actuator and the rail, for example between the third portion and the first portion and/or second portion of the running surface, is in a range from 0.1 mm to 10 mm, preferably in a range from 0.5 mm to 5 mm, more preferably in a range from 1 mm to 3 mm, for example 2 mm. In this way, clearance around the actuator is provided during the movement thereof while a continuity of the running surface is improved for a smoother ride.

In one example, the stop comprises a set of actuators, including the actuator, for example a pair thereof, such as arranged on either side of the rail.

Arm

The stop comprises the arm, coupled to the actuator.

It should be understood that the arm is a moveable arm, moveable between the first configuration and the second configuration. In one example, the arm is a moveable arm, for example pivotable and/or translatable, moveable between the first configuration wherein the arm is arranged to block the trolley therepast, and the second configuration, wherein the arm is arranged to allow the trolley therepast.

The arm is coupled to the actuator. In one example, the arm is directly coupled to the actuator. In one example, the arm is indirectly coupled to the actuator. In one example, the arm is indirectly coupled to the actuator via linkage, a cable and/or an electric motor. In one example, the movement of the actuator results in a respective movement of the arm and optionally, vice versa. In one example, the movement of the actuator and the respective movement of the arm are similar, for example in direction, rotation, distance and/or speed. In one example, the movement of the actuator and the respective movement of the arm are dissimilar. For example, the movement of the actuator may be linear and the respective movement of the arm may be rotational, or vice versa.

In the first configuration, the arm is arranged to block the trolley therepast. In one example, in the first configuration, the arm is arranged to contact the trolley, for example a frame thereof such as a front surface of the frame, so as to prevent the trolley from travelling therepast. In one example, in the first configuration, the arm is arranged to resist a force applied thereon by or via the trolley.

In the second configuration, the arm is arranged to allow the trolley therepast. In one example, in the second configuration, the arm is arranged clear of (i.e. not in contact with, not obstructing) the trolley.

In one example, the actuator and the arm are spaced apart axially whereby a frame of the trolley, such as a front surface of the frame, contacts the arm and the first wheel is on the actuator. In this way, the stop may be moved from the first configuration to the second configuration by the actuation of the actuator, preferably by the movement of the actuator due, at least in part, to a force imposed thereupon through the first wheel while the trolley is blocked by the arm. In one example, the set of wheels includes a second wheel, spaced axially from the first wheel, wherein, in use, the first wheel and the second wheel are arrangeable on the first portion and the third portion, respectively, of the running surface and/or wherein the first wheel and the second wheel are arrangeable on the third portion and the second portion, respectively, of the running surface. In this way, the stop may be moved from the first configuration to the second configuration by the actuation of the actuator, preferably by the movement of the actuator due, at least in part, to a moment imposed upon the actuator through the first wheel about the second wheel while the trolley is blocked by the arm. In one example, the actuator and the arm are spaced apart axially by a spacing of most a length of the trolley, preferably in a range from a wheelbase of the trolley to the length of the trolley. In one example, the actuator and the arm are spaced apart axially by a spacing in a range from 10 cm to 100 cm, preferably in a range from 20 cm to 80 cm, more preferably in a range from 25 cm to 50 CM.

In one example, the stop comprises a set of arms, including the arm, for example a pair thereof, such as arranged on either side of the rail.

First Configuration

The stop is arrangeable in the first configuration, wherein the arm is arranged to block the trolley therepast, as described above.

Second Configuration

The trolley is arrangeable in the second configuration, wherein the arm is arranged to allow the trolley therepast, as described above.

Moving from the First Configuration to the Second Configuration

The stop is arranged to move from the first configuration to the second configuration by actuation of the actuator, preferably by a movement of the actuator in the direction transverse to the third portion of the running surface, as described above.

In one example, the actuation of the actuator is for a threshold time, for example in a range from 1 s to 60 s, preferably in a range from 3 s to 30 s.

In one example, the movement of the actuator comprises and/or is a threshold movement. That is, a maximum or preferably minimum movement of the actuator may be required to move the stop from the first configuration to the second configuration. In one example, the threshold movement is a predetermined threshold movement, for example a movement in a range from 1 mm to 20 mm, preferably in a range from 2 mm to 10 mm, more preferably in a range from 3 mm to 7 mm, for example 4, 5 or 6 mm. In one example, the threshold movement is a predetermined threshold movement, for example a movement in a range from 10° to 60°, preferably in a range from 15° to 45°, more preferably in a range from 20° to 30°, for example 25°. In one example, the threshold movement is adjustable, for example within the ranges described above. In one example, the threshold movement is adjusted by setting a lower and/or an upper limit of the movement, for example using threaded fasteners and/or resilient biasing means.

In one example, the movement of the actuator is due, at least in part, to a force imposed thereupon, for example through the first wheel, for example as described above. In one example, the movement of the actuator is due, at least in part, to a threshold force imposed thereupon, for example through the first wheel. That is, a maximum or preferably minimum force may be required to cause, at least in part, the movement of the actuator to move the stop from the first configuration to the second configuration. In one example, the threshold force is a predetermined threshold force, for example a force in a range from about 100 N to about 1,000 N, preferably in a range from about 200 N to about 750 N, more preferably in a range from about 300 N to about 500 N, for example about 400 N (i.e. corresponding to a weight due to a mass in a range from about 10 kg to about 100 kg, preferably in a range from about 20 kg to about 75 kg, more preferably in a range from about 30 kg to about 50 kg, for example about 40 kg respectively). Such a predetermined threshold force may correspond with a weight of a user, for example a weight of a lightest user permitted for a zipline ride. Hence, such a user would have to be fully suspended from the trolley, via a harness attached thereto, so as to cause the stop to move from the first configuration to the second configuration arising from the movement of the actuator due, at least in part, to a weight of the user imposed thereupon, for example through the first wheel. In one example, the threshold force is adjustable, for example within the ranges described above. In one example, the threshold force is adjusted by setting a lower and/or an upper limit of the threshold force, for example using threaded fasteners and/or resilient biasing means.

In one example, the movement is a non-linear movement, for example an arcuate movement.

In one example, the movement is a linear movement, preferably orthogonal to the third portion of the running surface. In one example, the movement comprises and/or is a depression of the actuator, for example due to a force applied thereupon through the first wheel.

Biasing Members

In one example, the stop comprises a first biasing member arranged to bias the stop in the first configuration. That is, the stop may be biased in the closed configuration. In one example, the first biasing member comprises and/or is a spring, for example a mechanical spring such as a tension spring or a compression spring provided by a helical spring, a cantilever spring, or a volute spring, a gas spring and/or an elastomeric material, such natural or synthetic rubber.

In one example, the stop comprises a second biasing member arranged to bias the actuator against the movement. In this way, the second biasing member may move the stop from the second configuration to the first configuration, for example after the trolley has traveled beyond the arm.

Latch

In one example, the stop comprises a latch, wherein the arm is coupled to the actuator via the latch, wherein:

in the first configuration, the latch is arranged to retain the arm; and in the second configuration, the latch is arranged to release the arm.

That is, the arm is indirectly coupled to the actuator via the latch. The latch is arranged to retain (i.e. hold, secure, maintain) the arm in the first configuration, for example by interlocking with the arm. In this way, the arm may resist a force applied thereon by or via the trolley, as described above. The latch is arranged to release (i.e. free) the arm in the second configuration. In this way, the arm may move to the second configuration.

In one example, the latch is coupled to the actuator, for example by a coupling member such as a tie rod. In one example, the latch comprises and/or is a pivotable latch. In this way, a linear movement of the actuator may be transferred into a rotational movement of the latch.

Monorail and Suspended Rail Stops

In one example, the stop comprises and/or is a monorail stop. That is, the trolley runs on a single running surface and the rail is arranged to form a monorail.

In one example, the stop comprises and/or is a suspended rail stop. That is, a user is suspended from the trolley running on the running surface and the user travels through a region under the rail.

In one example, the stop comprises and/or is a suspended monorail stop.

Stop Assembly

A second aspect provides a stop assembly comprising a stop according to the first aspect and a section of rail for a trolley comprising a set of wheels, including a first wheel, the rail providing, at least in part, a running surface, including a first portion and a second portion thereof, for the first wheel.

The rail, the trolley, the set of wheels, the first wheel, the running surface, the first portion and/or the second portion may be as described with respect to the first aspect.

In one example, the first portion and the second portion of the running surface are transversely thereto mutually offset, wherein:

in the first configuration, the first portion and the third portion of the running surface are mutually aligned, thereby providing a first continuous running surface thereon; and in the second configuration, the second portion and the third portion of the running surface are mutually aligned, thereby providing a second continuous running surface thereon.

Section of Rail

In one example, the section of rail comprises a cylindrical tube, wherein the running surface comprises a cylindrical running surface or a part thereof and wherein the section of rail comprises a flange, for example upstanding from the cylindrical tube, as described below in more detail.

In one example, a length of the section of rail is in a range from 0.10 m to 5 m, preferably in a range from 0.25 m to 2.5 m, more preferably in a range from 0.50 m to 1.25 m, for example 0.80 m.

In one example, the stop assembly comprises two such sections of rail, respectively providing the first portion and the second portion of the running surface. In one example, a flange upstanding from such sections of rail extends thereacross.

Releasable Rail Coupling

In one example, the section of rail comprises a first part of a releasable rail coupling. In this way, the stop assembly may be releasably coupled to adjacent, corresponding rail sections.

In one example, the rail coupling is formed, for example machined, from steel according to EN 10025: part 2: 2004 grade S185, S235, S275, S355 or equivalent. In one example, the rail coupling is coated, for example powder coated, painted and/or galvanized, to improve corrosion resistance.

Rail Track

A third aspect provides a rail track, or a kit of parts for a rail track, comprising a set of rails and a stop according to the first aspect or a stop assembly according to the second aspect.

Trolley Assembly

A fourth aspect provides a trolley assembly comprising:
a stop assembly according to the second aspect; and
a trolley comprising a frame, a set of wheels, including a first wheel, rotatably coupled to the frame; and an attachment member, coupled to the frame, for attachment, preferably suspension, of a load therefrom, in use.

The trolley may be as described with respect to the fifth aspect.

Trolley

The fifth aspect provides a trolley for a rail providing a running surface for a wheel, the trolley comprising:
a frame;
a set of wheels, including a first wheel and optionally a second wheel, rotatably coupled to the frame; and
an attachment member, coupled to the frame, for attachment, preferably suspension, of a load therefrom, in use.

In one example, the trolley comprises a set of handles, for example a pair thereof, coupled to the frame for holding by a user.

In one example, the attachment member is arranged at a midpoint of the frame and the handles are coupled to the frame at the front of the frame, proximal to the second wheel and distal from the first wheel. In this way, pulling downwards on the handles, for example, imparts a force, at least predominantly, through the second wheel. In contrast, pulling downwards on the attachment member imparts a force, substantially equally, through the first wheel and the second wheel.

In one example, the trolley comprises:
the frame;
the set of wheels, including the first wheel and a second wheel, rotatably coupled to the frame; and
the attachment member, coupled to the frame, for attachment, preferably suspension, of the load therefrom, in use;
optionally, a set of handles, for example a pair thereof, coupled to the frame for holding by a user;
wherein the first wheel is rotatable in a first plane about a first axis and the second wheel is rotatable in a second plane about a second axis;
wherein the first plane and the second plane define a line;
wherein the trolley is arrangeable in:
a first configuration, wherein the attachment member is arranged at a first angular displacement about the line; and
a second configuration, wherein the attachment member is arranged at a second angular displacement about the line, wherein the first angular displacement and the second angular displacement are different.

In one example, the trolley is a captive trolley, as described above. In one example, the set of wheels is arranged to retain the trolley on a rail. That is, the trolley may not be directly removed from the rail without removing one or more wheels, for example. It should be understood that the trolley may be indirectly removed from the rail by unloading via the switch.

Typically, the load comprises and/or is a user, having a mass in a range from 30 kg to 120 kg and hence a weight in a range from 294 N to 1,177 N. In addition, centripetal forces due to cornering may add up to 1.5 g horizontally (i.e. up to 441 N to 1,766 N). Furthermore, an increased vertical load due to down swing (for example, the user swinging from an incline to a vertical position) may add up to 0.6 g vertically (i.e. up to i.e. up to 176 N to 706 N) with no horizontal component. The user may be attached to the attachment member via a harness (also known as a suspension harness), for example. The harness may be include a dorsal D-ring, for example, for attaching to the attachment member via a sling or lanyard. In this way, in use, the user may be suspended in a hang glider-type (also known as a superman) position (i.e. prone or face down). The trolley may include a set of handles, for the user to hold when in such a prone or face-down position.

It should be understood that, in use, the load results in (i.e. gives rise to) a downwards vertical force due to gravity, which may be imposed, at least in part, on the rail via the trolley. The load may result in (i.e. give rise to) other forces, for example due to pitching, yawing and/or rolling of the load and/or due to centripetal forces on the load, as described below, that may be imposed on the trolley and/or on the rail via the trolley. It should be understood that the rail is generally inclined, having a mean gradient typically in a range from 1 in 10 to 1 in 60, though may include one or more descending portions, ascending portions and/or horizontal portions. For example, a rail may include an initial length having a mean gradient of about 1 in 13 (to accelerate the trolley initially), followed by an intermediate length having a mean gradient of about 1 in 25 (corresponding approximately with constant speed of the trolley) and a final length having a mean gradient of about 1 in 50 (to decelerate the trolley).

Definitions

Throughout this specification, the term "comprising" or "comprises" means including the component(s), unit(s), module(s), feature(s) or integer(s) specified but not to the exclusion of the presence of other components, units, modules, features or integers.

The term "consisting of" or "consists of" means including the component(s), unit(s), module(s), feature(s) or integer(s) specified but excluding other components, units, modules, features or integers.

Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

BRIEF DESCRIPTION OF THE DRAWINGS

For a better understanding of the invention, and to show how exemplary embodiments of the same may be brought into effect, reference will be made, by way of example only, to the accompanying diagrammatic Figures, in which.

DETAILED DESCRIPTION OF THE DRAWINGS

Stop

Figure 1:
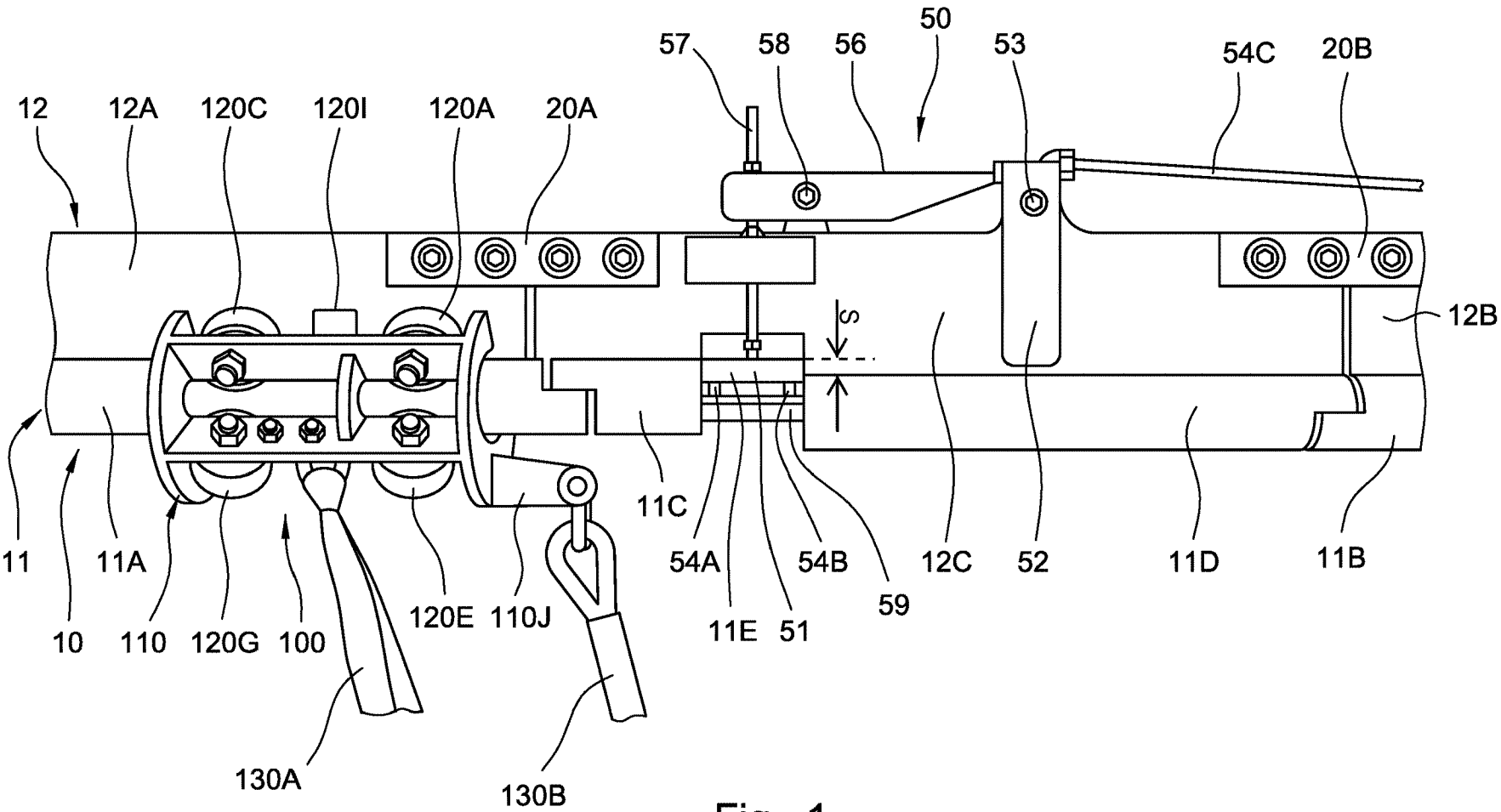
FIG. 1 schematically depicts a perspective view of a stop according to an exemplary embodiment, arranged in a first configuration.

FIG. 1 schematically depicts a perspective view of a stop 50 according to an exemplary embodiment, arranged in a first configuration.

The stop 50 is part of a stop assembly including the stop 50 and a section of rail 10. The stop assembly is arranged between two other sections of rail providing, at least in part, a running surface, including a portion 11A and a portion 11B thereof. The stop assembly is coupled to these two other section of rail by mechanical couplings 20A and 20B, respectively coupling flanges 12A to 12C and 12C to 12B thereof. A trolley 100 is captive on the rail 10.

The stop 50 is for stopping the trolley 100 on a rail 10, the trolley 100 comprising a set of wheels 120, including a first wheel 120C, the rail 10 providing, at least in part, a running surface, including a first portion 11C and a second portion 11D thereof, for the first wheel 120C. The stop 50 comprises an actuator 51 providing a third portion 11E of the running surface between the first portion 11C and the second portion 11D and an arm 52, coupled to the actuator 51.

The stop 50 is arrangeable in a first configuration, wherein the arm 52 is arranged to block the trolley 100 therepast. The stop is arrangeable in a second configuration, wherein the arm 52 is arranged to allow the trolley 100 therepast. The stop 50 is arranged to move from the first configuration to the second configuration by actuation of the actuator, preferably by a movement of the actuator 51 in a direction transverse to the third portion 11E of the running surface.

Hence, in the first configuration, the arm 52 blocks the trolley 100, thereby stopping the trolley 100 from running beyond the stop 50 on the rail 10. In contrast, in the second configuration, the arm 52 does not block the trolley 100, thereby allowing the trolley 100 to run beyond the stop 50 on the rail 10. The second configuration may be known as an open configuration. That is, the stop 50 acts a releasable barrier, that selectively allows (i.e. permits, lets, frees) the trolley 100 to run beyond the stop 50 on the rail 10. Moving of the stop 50 from the first configuration to the second configuration is by the actuation of the actuator, preferably by the movement of the actuator 51 in the direction transverse to the third portion 11E of the running surface. That is, this movement of the actuator 51 controls opening (i.e. releasing) the stop. Particularly, the movement of the actuator 51 to move the stop 50 from the first configuration to the second configuration is transverse to the third portion 11E of the running surface provided by the actuator 51. That is, the movement is transverse to the direction along the rail 10 or the running surface and hence transverse to the direction in which the user would attempt to push or pull the trolley 100 along the rail 10 beyond the stop. In other words, pushing or pulling the trolley 100 along the rail 10 will not open the stop. Rather, in order to open the stop 50 (i.e. move the stop 50 from the first configuration to the second configuration), the actuator 51 is moved transversely to the direction in which the user is pulling or pushing the trolley 100 along the rail 10. Furthermore, the actuator 51 provides the third portion 11E of the running surface between the first portion 11C and the second portion 11D of the running surface for the first wheel 120C of the trolley 100. Hence, the movement of the actuator 51 is due, at least in part, to a force imposed thereupon through the first wheel 120C, as described below in more detail. The force may arise from suspension of the user from the trolley 100, via the user's harness attached to the trolley 100, such that the stop 50 will open (i.e. move from the second configuration to the first configuration) only if the user is suspended from the trolley 100, rather than the user merely attempting to push or pull the trolley 100 along the rail 10 beyond the stop. In this way, safety is improved since the user may only move the trolley 100 beyond the stop 50 if suspended therefrom.

Trolley

The trolley 100 comprises a set of wheels 120, including the first wheel 120C of diameter 61 mm. The trolley 100 is as described below with respect to FIG. 9.

Rail

The rail 10 provides, at least in part, the running surface, including the first portion 11C and the second portion 11D thereof, for the first wheel 120C. Furthermore, other rail 10*s* and/or rail 10 sections included in a rail 10 track may also be as described below, mutatis mutandis.

In this example, the first portion 11C and the second portion 11D of the running surface are transversely thereto mutually offset. That is, a step S is provided between the first portion 11C and the second portion 11D such that the running surface provided by the first portion 11C and the second portion 11D is discontinuous thereacross.

In this example, the rail 10 comprises a cylindrical (i.e. a convex) running surface defining a cylinder axis, wherein the line is substantially coincident, in use, with the cylinder axis, for example provided by a tube (i.e. a section) having a circular cross-section. Hollow section is preferred, reducing a weight of the rail 10. In this example, the tube has an external diameter $D_{ext}$ of 60.3 mm. In this example, the tube has a wall thickness of 3.2 mm.

In this example, the rail 10 is formed from steel according to EN 10025: part 2: 2004 grade S355. In this example, the tube is seamless tube. In this example, the rail 10 is painted.

In this example, the rail 10 comprises a cylindrical tube 11, wherein the running surface comprises a cylindrical running surface or a part thereof and wherein the rail 10 comprises a longitudinal flange 12, having a thickness of about 10 mm, normal to the tube (i.e. upstanding therefrom) extending continuously along the tube.

Actuator

The stop 50 comprises the actuator 51 providing a third portion 11E of the running surface between the first portion 11C and the second portion 11D.

In this example, the first portion 11C and the second portion 11D of the running surface are transversely thereto mutually offset, by an offset of about 5 mm. In this example, in the first configuration, the first portion 11C and the third portion 11E of the running surface are aligned such that the running surface provided by the first portion 11C and the third portion 11E is continuous thereacross. In this example, in the first configuration, the second portion 11D and the third portion 11E of the running surface are transversely thereto mutually offset such that the running surface provided by the second portion 11D and the third portion 11E is discontinuous thereacross. In this example, in the second configuration, the second portion 11D and the third portion 11E of the running surface are aligned such that the running surface provided by the second portion 11D and the third portion 11E is continuous thereacross. In this example, in the second configuration, the first portion 11C and the third portion 11E of the running surface are transversely thereto mutually offset such that the running surface provided by the first portion 11C and the third portion 11E is discontinuous thereacross.

In this example, the actuator 51 is arranged to separate the first portion 11C and the second portion 11D of the running surface provided by the rail 10, for example longitudinally or axially. In this example, the first portion 11C and the second portion 11D of the running surface provided by the rail 10 are spaced apart by the actuator 51, for example longitudinally or axially. In this example, the third portion 11E of the running surface provided by actuator 51 is similar to and/or the same as (i.e. by cross-sectional shape and/or profile) the first portion 11C and/or the second portion 11D of the running surface provided by the rail 10.

In this example, an axial length of the actuator 51 is in a range from 0.75 D to 1.25 D, wherein D is the diameter of the first wheel 120C i.e. in a range from about 46 mm to about 76 mm. In this example, the set of wheels 120 includes a second wheel 120A, spaced axially from the first wheel 120C, wherein, in use, the first wheel 120C and the second wheel 120A are arrangeable on the first portion 11C and the third portion 11E, respectively, of the running surface and/or wherein the first wheel 120C and the second wheel 120A are arrangeable on the third portion 11E and the second portion 11D, respectively, of the running surface. In this way, the movement of the actuator 51 is due, at least in part, to a moment imposed thereupon through only the first wheel 120C about the second wheel.

In this example, an axial spacing between the actuator 51 and the rail 10, for example between the third portion 11E and the first portion 11C and/or second portion 11D of the running surface, is about 2 mm.

In this example, the actuator 51 is machined from steel according to EN 10025: part 2: 2004 grade S355. In this example, the actuator 51 is galvanized.

Arm

The stop 50 comprises the arm 52, coupled to the actuator 51. In this example, the arm 52 is a pivotable arm 52, arranged to pivot about a first pivot 53 in the flange 12C.

In this example, the arm 52 is indirectly coupled to the actuator 51. In this example, the movement of the actuator 51 results in a respective movement of the arm 52 and optionally, vice versa. In this example, the movement of the actuator 51 and the respective movement of the arm 52 are dissimilar. In this example, the movement of the actuator 51 is linear and the respective movement of the arm 52 is rotational.

In the first configuration, the arm 52 is arranged to block the trolley 100 therepast. In this example, in the first configuration, the arm 52 is arranged to contact the trolley 100, for example a frame 110 thereof such as a front surface of the frame 110, so as to prevent the trolley 100 from travelling therepast. In this example, in the first configuration, the arm 52 is arranged to resist a force applied thereon by or via the trolley 100.

In the second configuration, the arm 52 is arranged to allow the trolley 100 therepast. In this example, in the second configuration, the arm 52 is arranged clear of (i.e. not in contact with) the trolley 100.

In this example, the actuator 51 and the arm 52 are spaced apart axially whereby a frame 110 of the trolley 100, such as a front surface of the frame 110, contacts the arm 52 and the first wheel 120C is on the actuator 51. In this example, the set of wheels 120 includes the second wheel 120A, spaced axially from the first wheel 120C, wherein, in use, the first wheel 120C and the second wheel 120A are arrangeable on the first portion 11C and the third portion 11E, respectively, of the running surface and/or wherein the first wheel 120C and the second wheel 120A are arrangeable on the third portion 11E and the second portion 11D, respectively, of the running surface. In this way, the stop 50 is moved from the first configuration to the second configuration by the actuation of the actuator, preferably by the movement of the actuator 51 due, at least in part, to a moment imposed upon the actuator 51 through the first wheel 120C about the second wheel 120A while the trolley 100 is blocked by the arm 52.

First Configuration

The stop 50 is arrangeable in the first configuration, wherein the arm 52 is arranged to block the trolley 100 therepast, as described above.

Second Configuration

The trolley 100 is arrangeable in the second configuration, wherein the arm 52 is arranged to allow the trolley 100 therepast, as described above.

Moving from the First Configuration to the Second Configuration

The stop 50 is arranged to move from the first configuration to the second configuration a movement of the actuator 51 in the direction transverse to the third portion 11E of the running surface, as described above.

In this example, the movement of the actuator 51 comprises and/or is a threshold movement. In this example, the threshold movement is a predetermined threshold movement, for example a movement of about 5 mm.

In this example, the movement of the actuator 51 is due, at least in part, to a force imposed thereupon, for example through the first wheel 120C, for example as described above. In this example, the movement of the actuator 51 is due, at least in part, to a threshold force imposed thereupon, for example through the first wheel 120C. In this example, the threshold force is a predetermined threshold force, of about 400 N (i.e. corresponding to a weight due to a mass of about 40 kg respectively).

In this example, the movement is a linear movement, orthogonal to the third portion 11E of the running surface. In this example, the movement comprises and/or is a depression of the actuator 51, for example due to a force applied thereupon through the first wheel 120C.

Biasing Members

In this example, the stop 50 comprises a first biasing member 54C arranged to bias the stop 50 in the first configuration. In this example, the first biasing member 54C comprises and/or an elastomeric material, such as synthetic rubber, particularly a bungee cord. Alternatively, a spring such as a mechanical tension spring may be used, as described previously.

In this example, the stop 50 comprises a second biasing member 54A, 54B arranged to bias the actuator 51 against the movement. In this way, the second biasing member may move the stop 50 from the second configuration to the first configuration, for example after the trolley 100 has traveled beyond the arm 52.

Latch

In this example, the stop 50 comprises a latch 56, wherein the arm 52 is coupled to the actuator 51 via the latch 56, wherein:

in the first configuration, the latch 56 is arranged to retain the arm 52; and in the second configuration, the latch 56 is arranged to release the arm 52.

That is, the arm 52 is indirectly coupled to the actuator 51 via the latch 56. The latch is pivotable about a second pivot 58 on the flange 12C. The latch 56 is coupled to the actuator 51 by a coupling member such as a tie rod 57.

Monorail and Suspended Rail Stops

In this example, the stop 50 is a suspended monorail stop.

In Use

Figure 2:
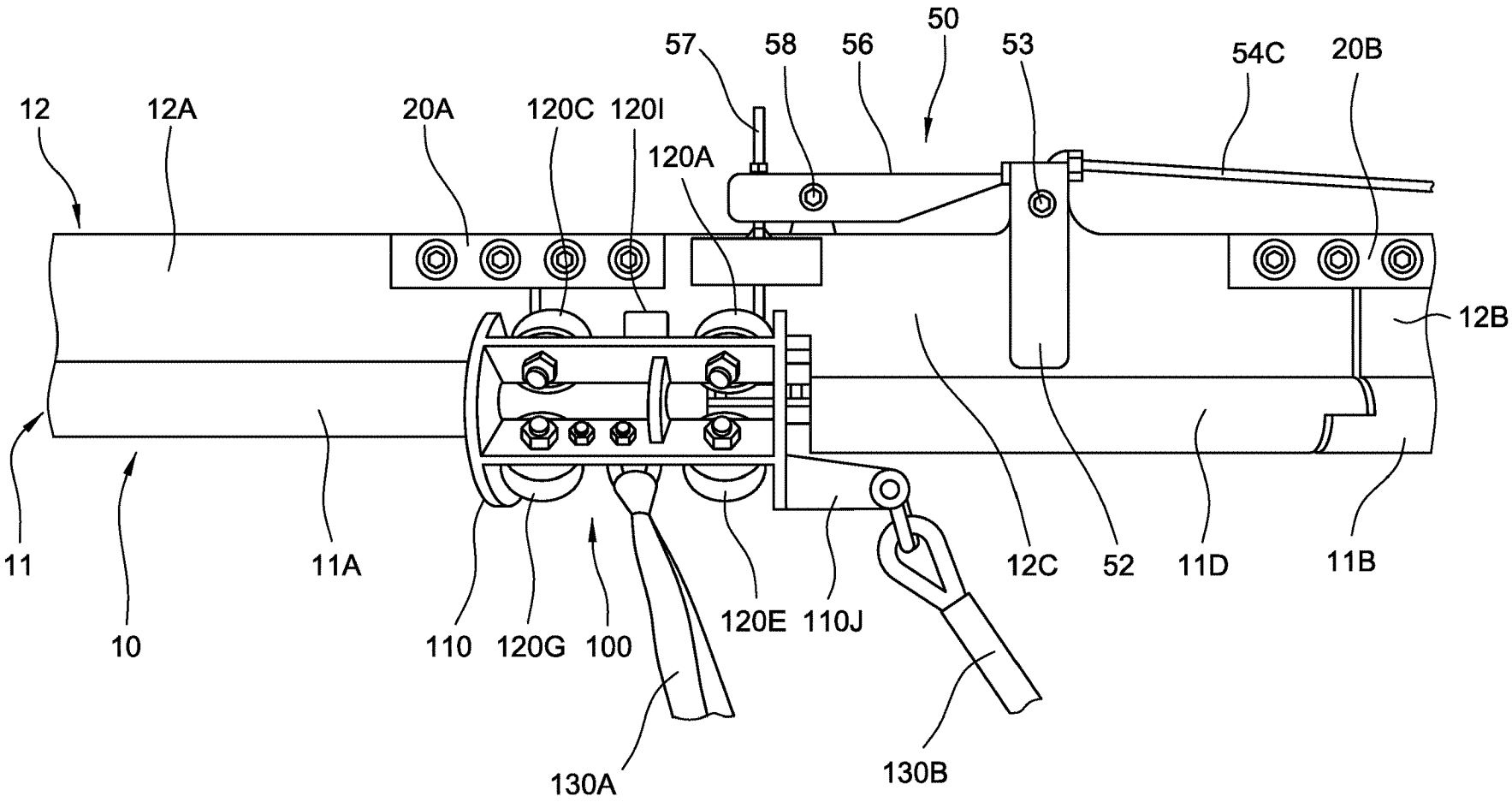
FIG. 2 schematically depicts a perspective view of the stop of FIG. 1, arranged in the first configuration.
Figure 3:
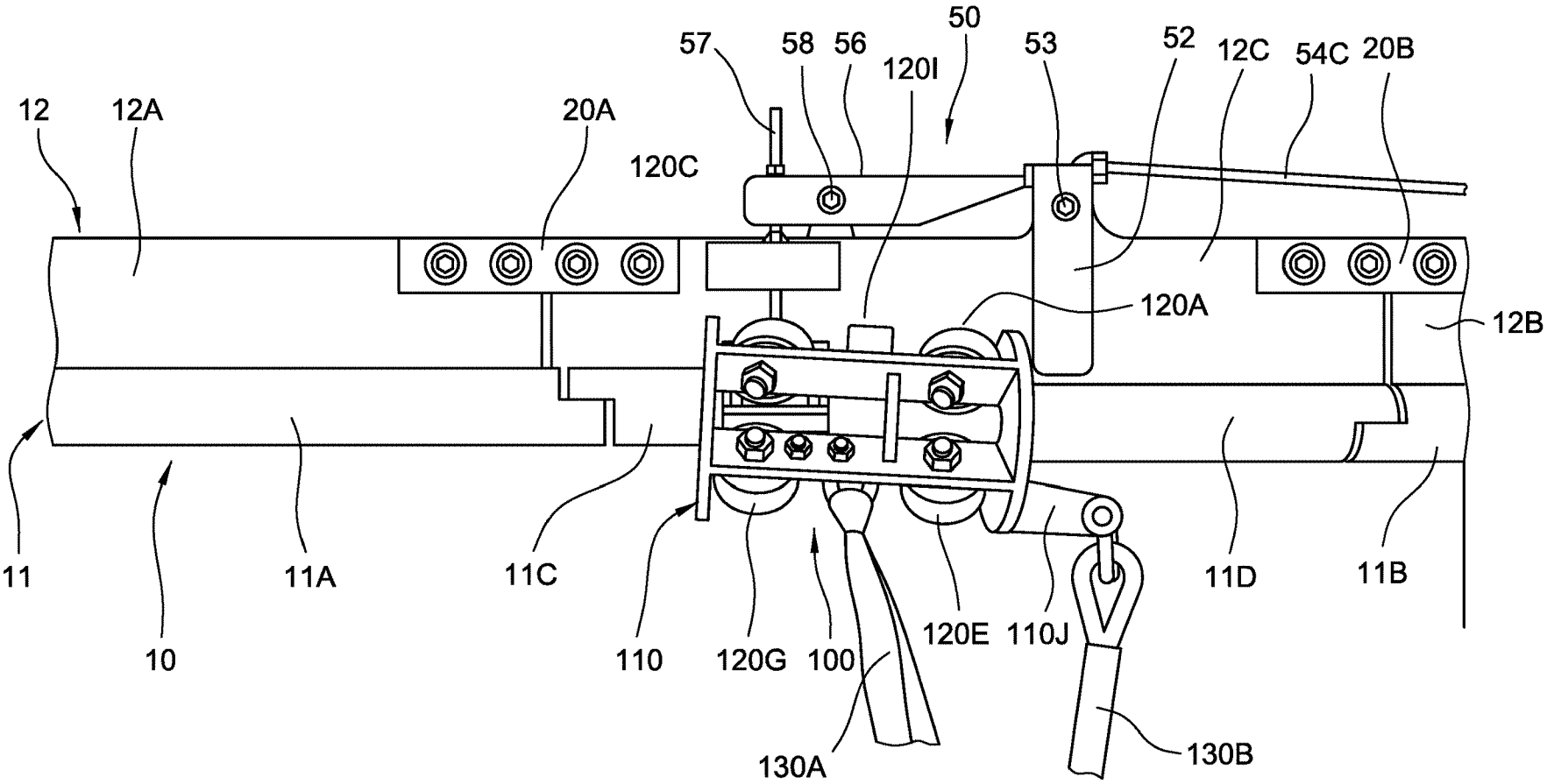
FIG. 3 schematically depicts a perspective view of the stop of FIG. 1, arranged in the first configuration.
Figure 4:
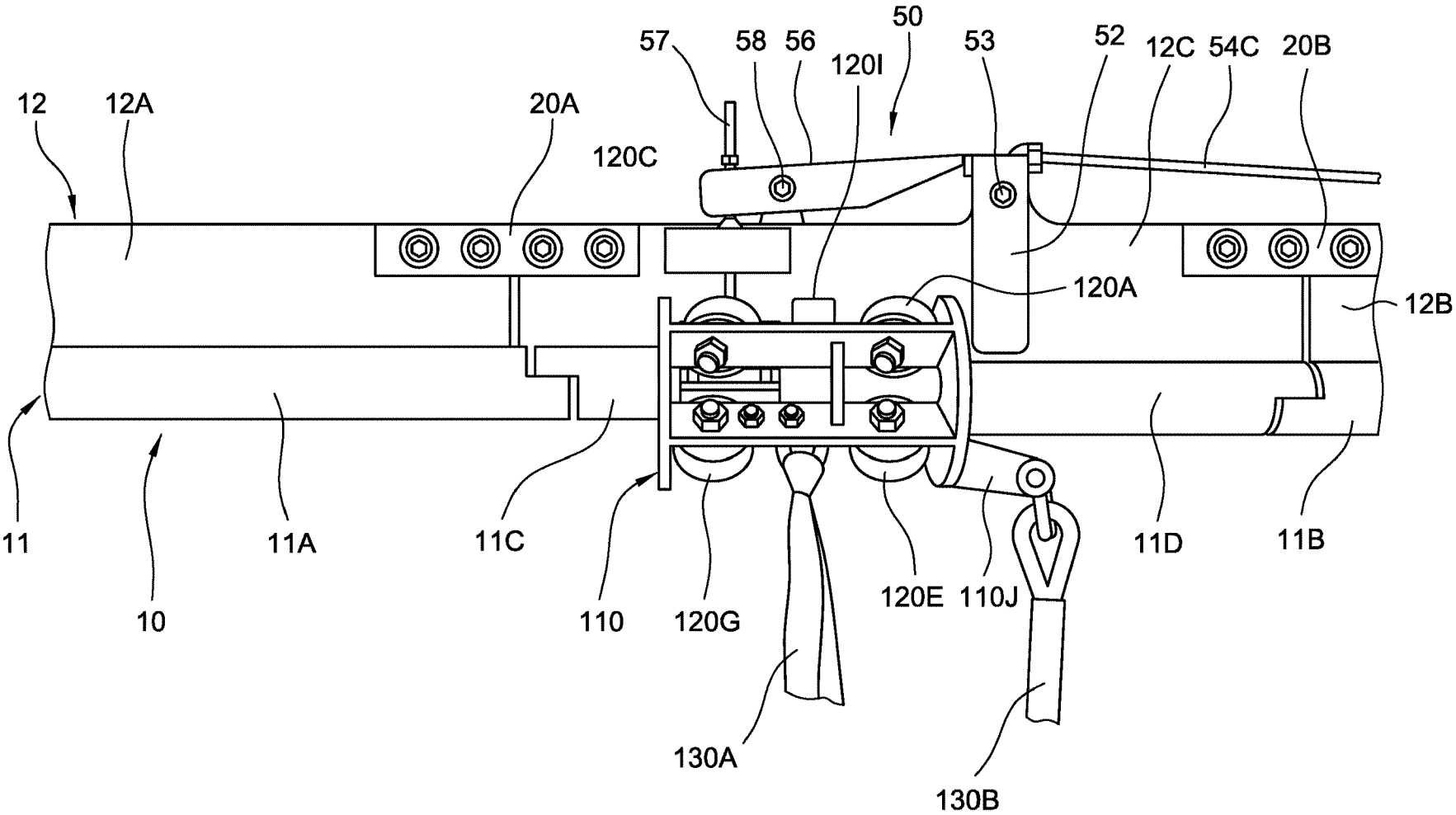
FIG. 4 schematically depicts a perspective view of the stop of FIG. 1, arranged in the first configuration.
Figure 5:
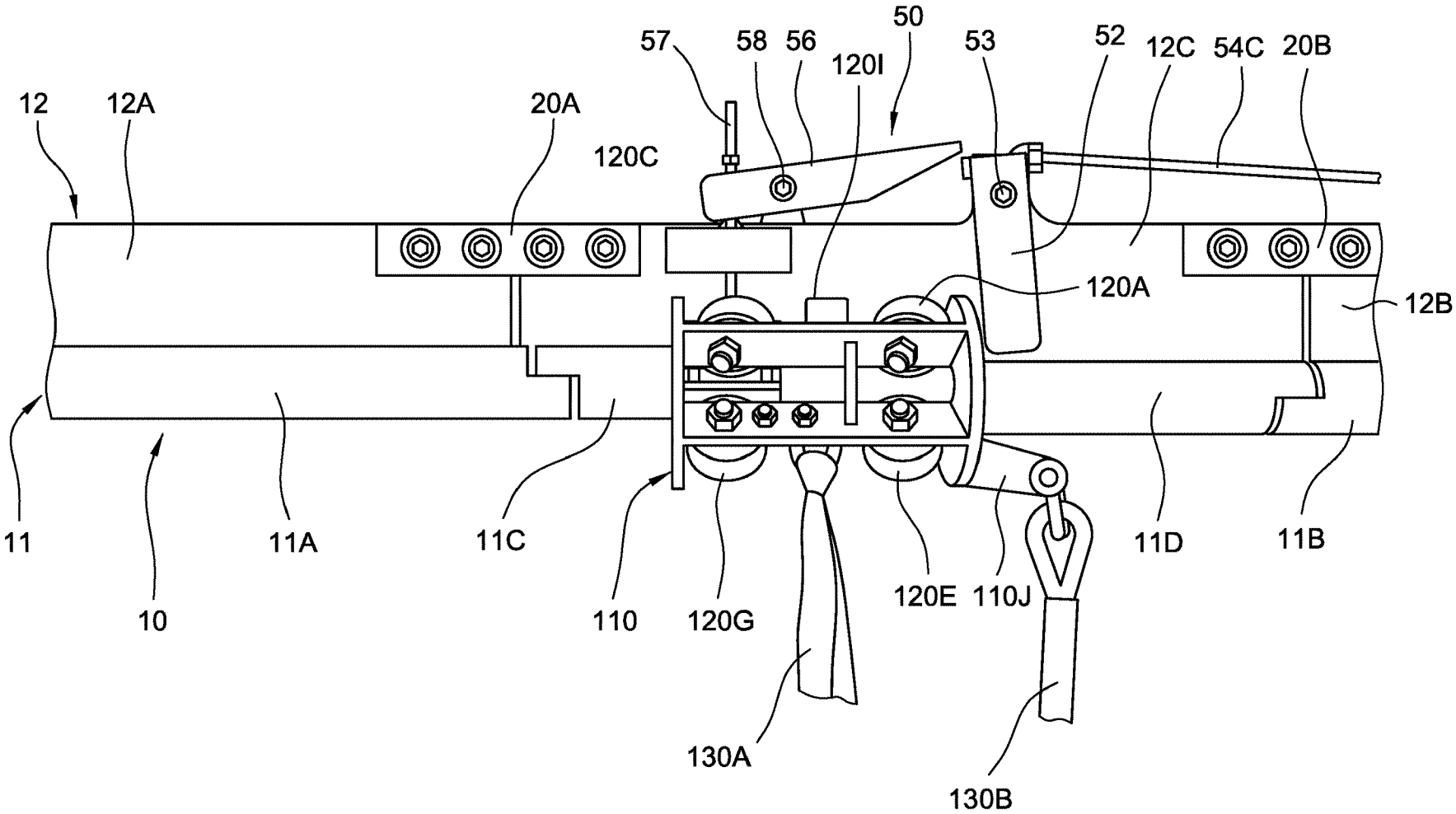
FIG. 5 schematically depicts a perspective view of the stop of FIG. 1, moving from the first configuration to a second configuration.
Figure 6:
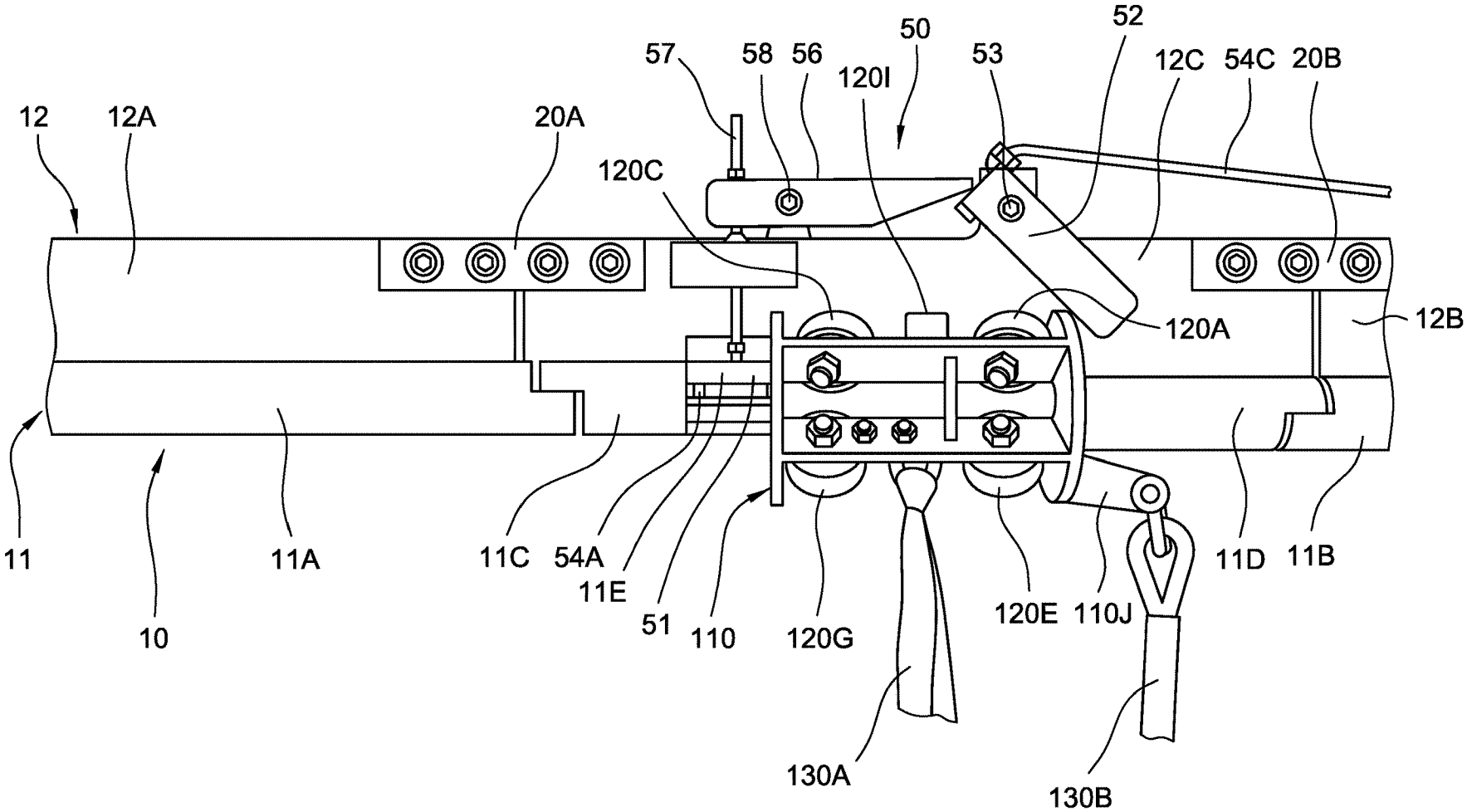
FIG. 6 schematically depicts a perspective view of the stop of FIG. 1, in the second configuration.
Figure 7:
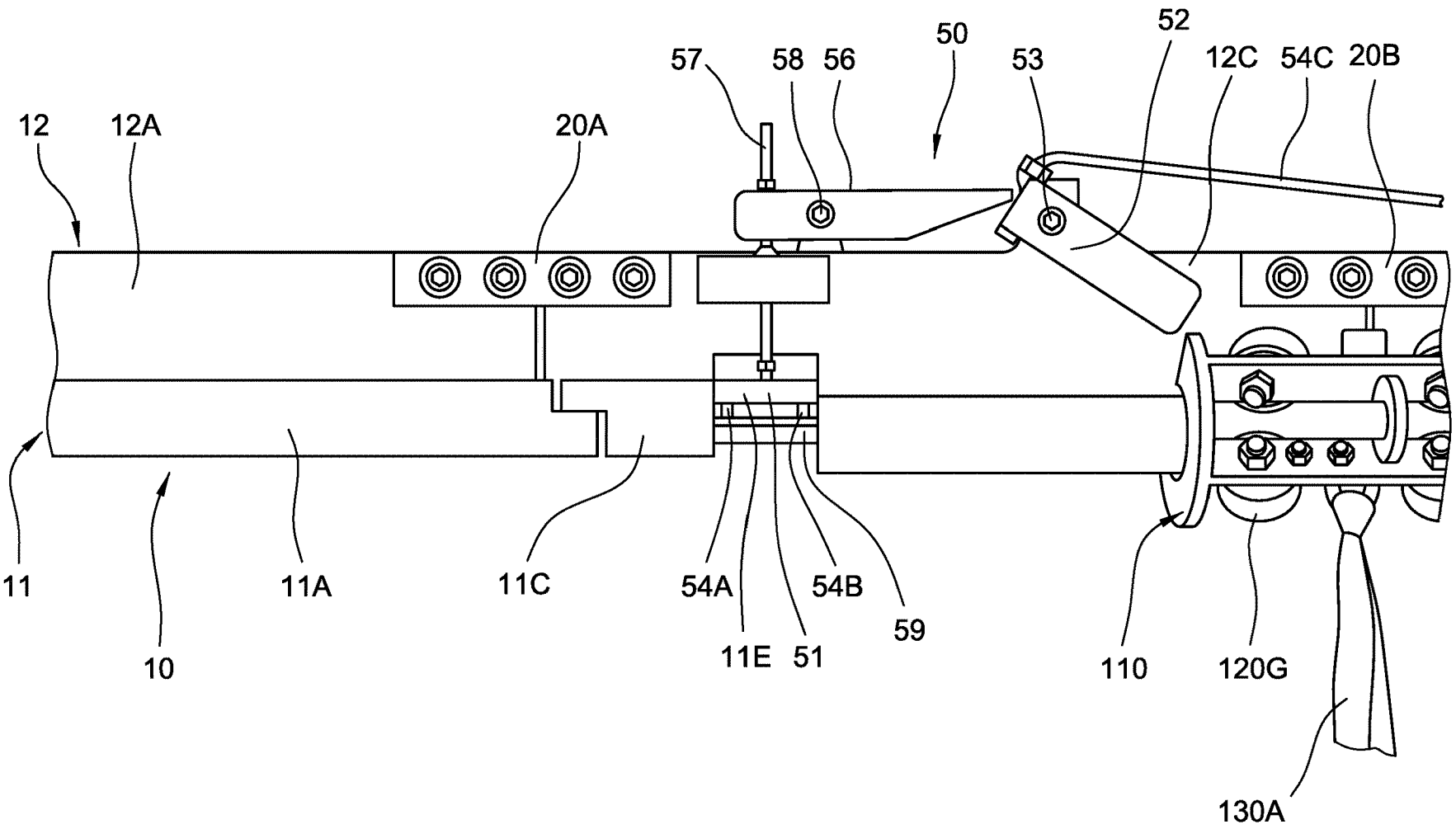
FIG. 7 schematically depicts a perspective view of the stop of FIG. 1, in the second configuration.
Figure 8:
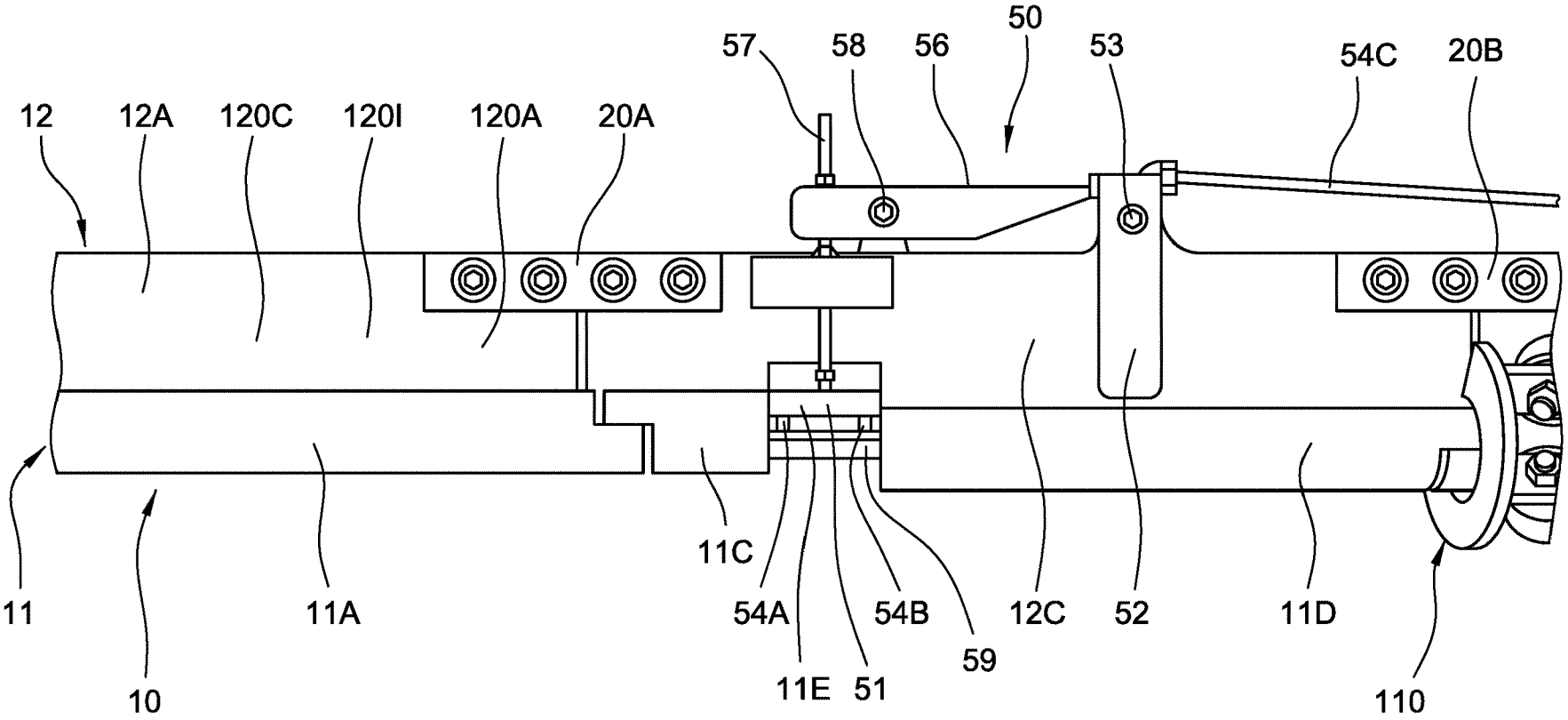
FIG. 8 schematically depicts a perspective view of the stop of FIG. 1, in the first configuration.

FIG. 2 to FIG. 8 show the stop 50, in use, as the trolley 100 travels from left to right along the rail 10. Particularly, FIG. 2 to FIG. 4 schematically depict a perspective view of the stop 50, arranged in the first configuration, FIG. 5 schematically depicts a perspective view of the stop 50, moving from the first configuration to a second configuration, FIG. 6 and FIG. 7 schematically depict a perspective view of the stop 50, in the second configuration and FIG. 8 schematically depicts a perspective view of the stop 50, in the first configuration.

As shown in FIG. 2, the trolley 100 is being pulled from left to right using the handles 130B, such that the second wheel 120A is on the third portion 11E of the running surface and the first wheel 120C is on the first portion 11C of the running surface, provided by the actuator 51. The trolley 100 is spaced apart from the arm 52, by less than a length of the trolley 100. The stop 50 is arranged in the first configuration, to thereby block the trolley 100 from travelling therepast.

As shown in FIG. 3, the trolley 100 is being pulled further from left to right using the handles 130B, such that the second wheel 120A is on the second portion 11D of the running surface and the first wheel 120C is on the third portion 11E of the running surface, provided by the actuator 51. The front of the frame 100 of the trolley 100 is in contact with the arm 52. The stop 50 is arranged in the first configuration, thereby blocking the trolley 100 from travelling therepast. Since the third portion 11E and the second portion 11D of the running surface are offset, the trolley 100 is tilted downwards towards the arm 52. Pulling downwards on the handles 130B applies a downwards force on the second wheel 120A, tending to tilt the trolley 100 further downwards towards the arm 52 and thus not actuating the actuator 51. Pulling on the handles towards the right presses the front of the frame 100 of the trolley 100 against the arm 52, which obstructs the trolley 100.

As shown in FIG. 4, in which the second wheel 120A is on the second portion 11D of the running surface and the first wheel 120C is on the third portion 11E of the running surface, provided by the actuator 51, pulling downwards on the attachment member 130A for a harness starts to actuate the actuator 51 by applying a downwards force thereon, resulting in the movement of the actuator 51 in a direction transverse to the third portion 11E of the running surface, thereby starting to move the stop 50 from the first configuration to the second configuration. As shown in FIG. 4, as the actuator 51 is depressed, the downwards movement of the actuator 51 is transferred via the coupling member such as a tie rod 57 to an end of the latch 56, pivotable about the pivot 58, such that the latch 56 rotates anticlockwise, while remaining latched with the arm 52 such that the arm 52 continues to block the trolley 100. As shown in FIG. 4, as the actuator 51 is depressed, the third portion 11E of the running surface moves towards alignment with the second portion 11D of the running surface.

As shown in FIG. 5, in which the second wheel 120A is on the second portion 11D of the running surface and the first wheel 120C is on the third portion 11E of the running surface, provided by the actuator 51, pulling further downwards on the attachment member 130A for a harness further actuates the actuator 51 by applying a downwards threshold force of about 400 N thereon, resulting in the threshold movement of the actuator 51 in the direction transverse to the third portion 11E of the running surface, thereby moving the stop 50 from the first configuration to the second configuration. As shown in FIG. 5, as the actuator 51 is depressed further, the further downwards movement of the actuator 51 is transferred via the coupling member such as a tie rod 57 to the end of the latch 56, pivotable about the pivot 58, such that the latch 56 rotates further anticlockwise and unlatches from the arm 52 such that the arm 52 rotates anticlockwise about the pivot 53 and thus does not obstruct the trolley 100. As shown in FIG. 4, as the actuator 51 is depressed by the threshold movement, the third portion 11E of the running surface is in alignment with the second portion 11D of the running surface.

As shown in FIG. 6, the trolley 100 is being pulled still further from left to right, partly past the arm 52, using the handles 130B, such that the second wheel 120A is on the second portion 11D of the running surface and the first wheel 120C is on the second portion 11D of the running surface. Since no force is applied to the actuator 51, the second biasing member 54A, 54B moves the actuator 51 to its position in the first configuration, with corresponding clockwise rotation of the latch 56. However, since the arm 52 is not latched by the latch 56, the stop remains in the second configuration while the trolley 100 is moving therepast.

As shown in FIG. 7, the trolley 100 is being pulled yet still further from left to right, almost fully past the arm 52, using the handles 130B, such that the second wheel 120A is on the second portion 11D of the running surface and the first wheel 120C is on the second portion 11D of the running surface. The arm 52 is not latched by the latch 56 such the stop remains in the second configuration until the trolley 100 moves fully therepast.

Figure 9:
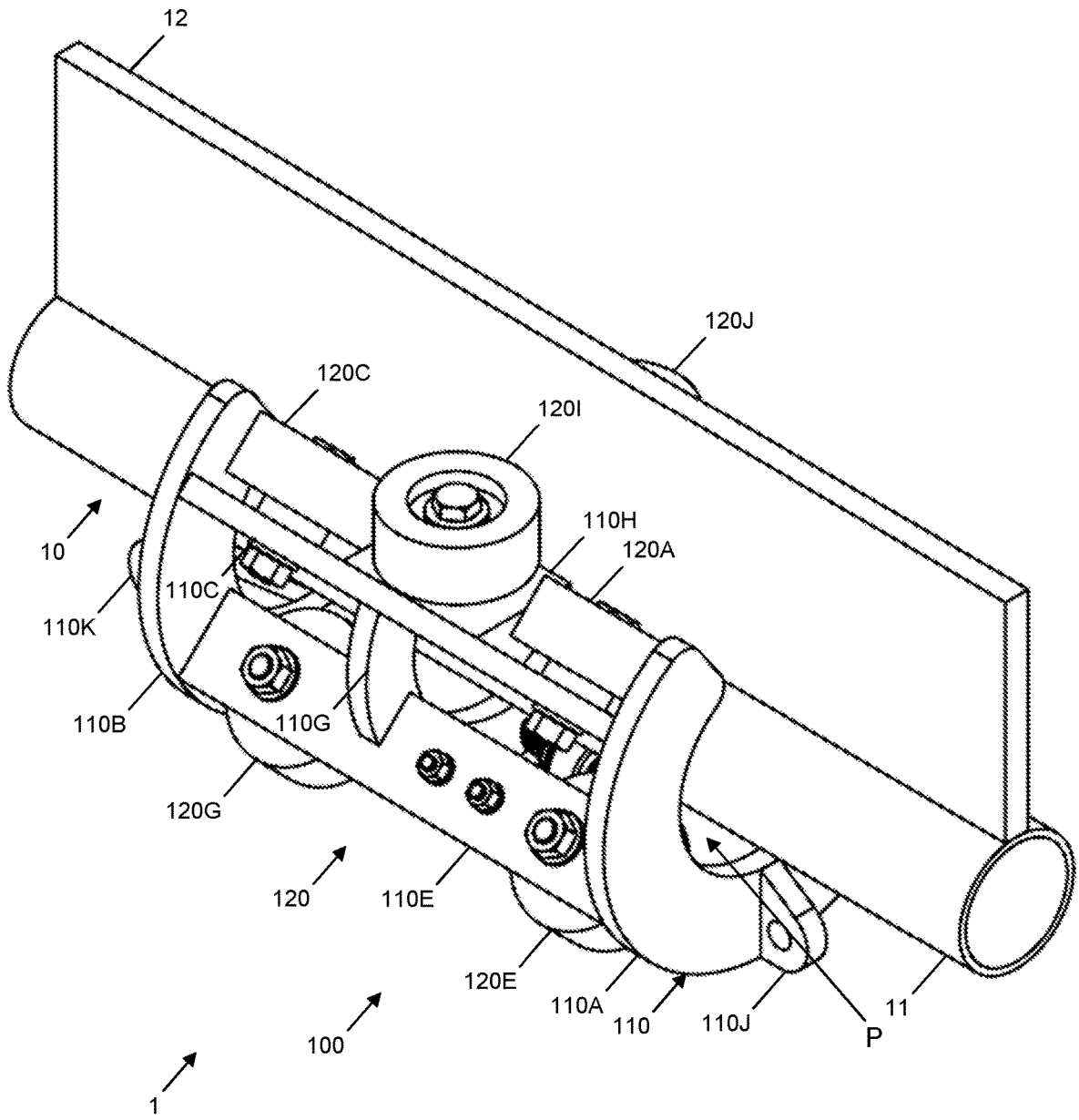
FIG. 9 schematically depicts a perspective view of a trolley according to an exemplary embodiment for the stop of FIG. 1.

As shown in FIG. 8, the trolley 100 is being pulled yet still even further from left to right, fully past the arm 52, using the handles 130B. The first biasing member 54C rotates the arm 52 clockwise about the pivot 53 until the latch 56 latches the arm 52, thereby moving the stop 50 back into the first configuration, FIG. 9 schematically depicts a perspective view of a trolley 100 according to an exemplary embodiment for the stop 50 of FIG. 1.

In this example, the trolley 100 comprises a frame 110; a set of wheels 120, including the first wheel 110C and the second wheel 120A, rotatably coupled to the frame 110; and the attachment member 130A (not shown), coupled to the frame 110, for attachment, preferably suspension, of the load L therefrom, in use. The first wheel 110A is rotatable in a first plane about a first axis and the second wheel is rotatable in a second plane about a second axis. The first plane and the second plane define a line. The trolley 100 is arrangeable in: a first configuration, wherein the attachment member (not shown) is arranged at a first angular displacement about the line; and a second configuration, wherein the attachment member (not shown) is arranged at a second angular displacement about the line, wherein the first angular displacement and the second angular displacement are different.

The frame 110 comprises front, mid and rear C plates 110A, 110G, 110B, ribs 110C to 110F (110D and 110F not shown) extending between the front and rear C plates 110A, 110B, the attachment member 130A coupled to the mid C plate 110G, and a first lug 110J and a second lug 110K respectively coupled to the front and rear C plates 110A, 110B.

The set of wheels 120 includes ten wheels 120A to 120J (wheels 120B, 120D, 120F, 120H not shown and arranged symmetrically about a midplane of the trolley 100 with respect to the opposed wheels 120A, 120C, 120E, 120G respectively).

The attachment member 130A is arranged at a midpoint of the frame 110. The handles 130B (not shown) are attached to the frame 110 via a first lug 110J at the front of the frame 110, beyond while proximal to the second wheel 120A and distal from the first wheel 110A. The frame 110 includes a second lug 110K at the back of the frame 110.

In this example, the trolley 100 is a captive trolley 100, as described above. In this example, the set of wheels 120 are arranged to retain the trolley 100 on a rail.

Figure 10:
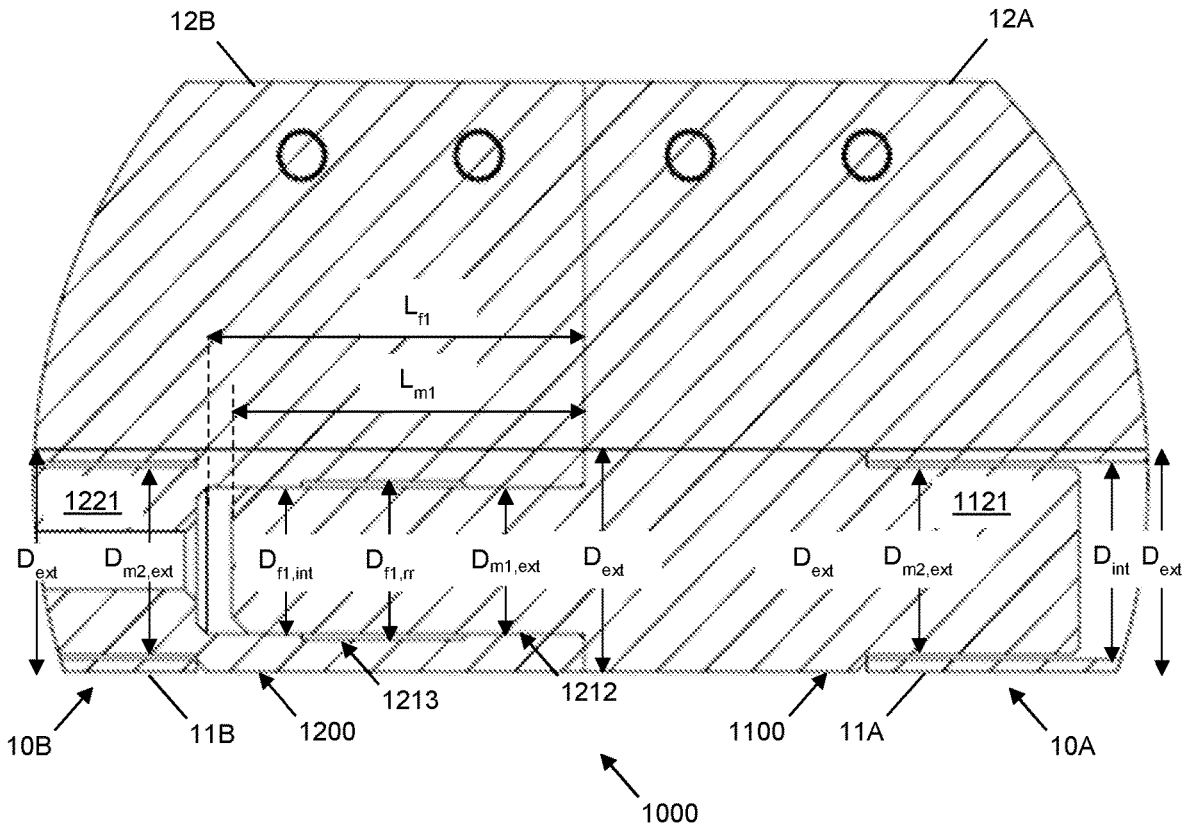
FIG. 10 schematically depicts a longitudinal cross-sectional view of a releasable rail coupling for the stop of FIG. 1.

FIG. 10 schematically depicts a longitudinal cross-sectional view of a releasable rail coupling 1000 for the stop 50 of FIG. 1.

Figure 11:
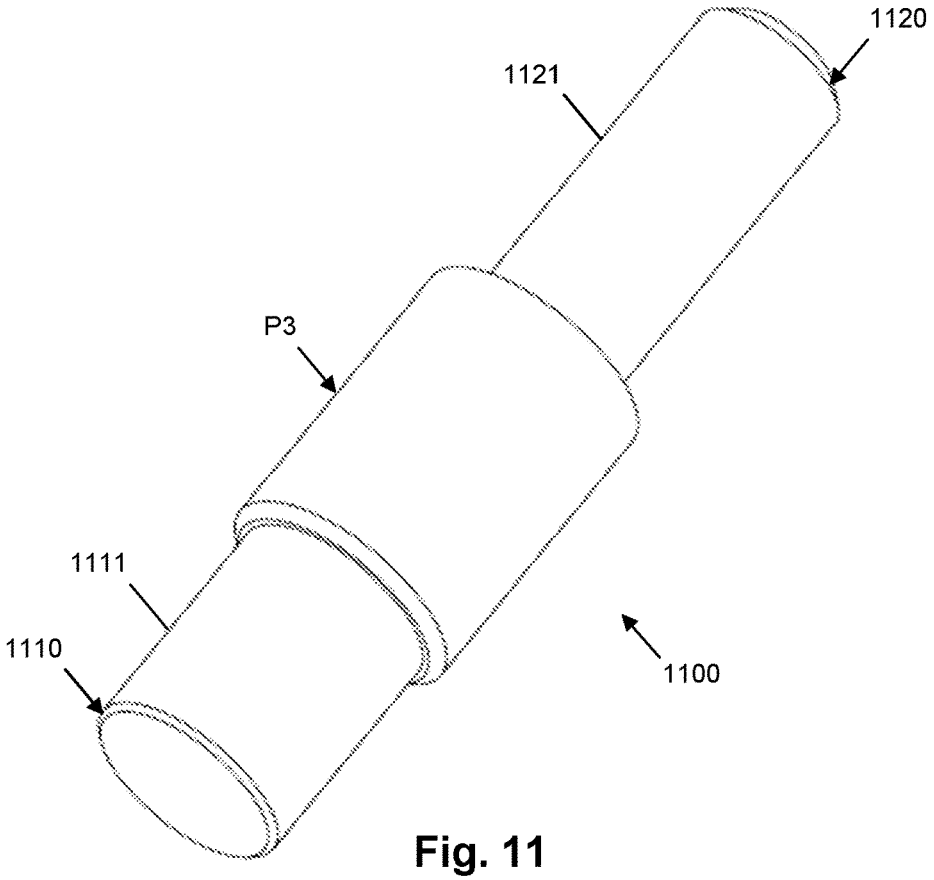
FIG. 11 schematically depicts a first part of the releasable rail coupling of FIG. 10.

FIG. 11 schematically depicts a first part 1100 of the releasable rail coupling 1000 of FIG. 10.

Figure 12:
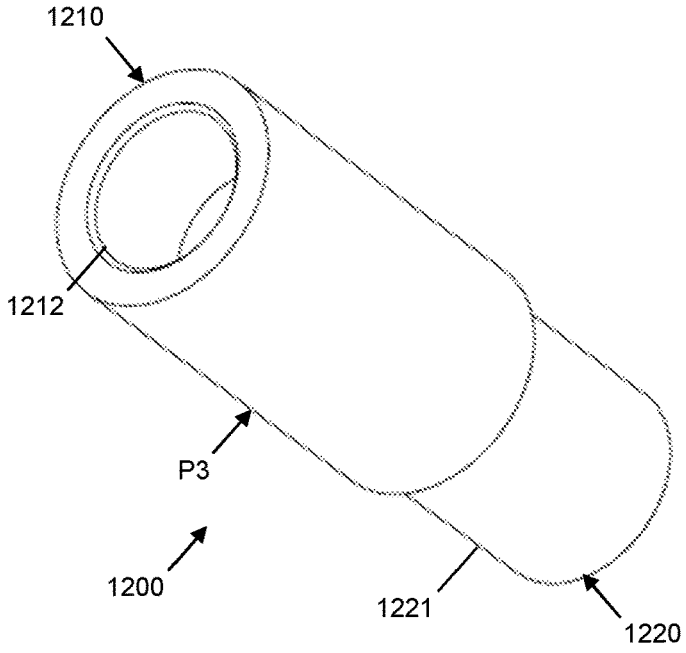
FIG. 12 schematically depicts a second part of the releasable rail coupling of FIG. 10.

FIG. 12 schematically depicts a second part 1200 of the releasable rail coupling 1000 of FIG. 10.

In this example, the first rail section comprises a first part 1100 of a releasable rail coupling 1000 joined to a second end E2 of the first rail 10A and the second rail 10B section comprises a second part 1200 of the releasable rail coupling 1000 joined to a first end E1 of the second rail 10B. In this way, the switch 20 may be releasably coupled to adjacent, corresponding rail sections.

In more detail, the releasable rail coupling 1000 is for releasably coupling a first rail 10A providing a first portion P1 of a running surface for a wheel and a second rail 10B providing a second portion P2 of the running surface. The rail coupling 1000 comprises a first part 1100 having a first end 1110 comprising a first male coupling member 1111 and a second end 1120 arranged for joining to the first rail 10A. The rail coupling 1000 comprises a second part 1200 having a first end 1210 comprising a corresponding first female coupling member 1212, arranged to receive the first male coupling member 1111 therein, and a second end 1220 arranged for joining to the second rail 10B. The rail coupling 1000 is arrangeable in: a first configuration wherein the first male coupling member 1111 and the first female coupling member 1212 are uncoupled; and a second configuration wherein the first male coupling member 1111 and the first female coupling member 1212 are coupled by receiving the first male coupling member 1111 in the first female coupling member 1212. The rail coupling 1000 provides a third portion of the running surface in the second configuration.

In this way, assembly and/or disassembly of the first rail 10A (i.e. a first length L1 of rail) and the second rail 10B (i.e. a second length of rail) may be facilitated and/or errors in assembly reduced.

In this example, the rail coupling 1000 is machined, from steel according to EN 10025: part 2: 2004 grade S355. In this example, the rail coupling 1000 is powder coated.

Although a preferred embodiment has been shown and described, it will be appreciated by those skilled in the art that various changes and modifications might be made without departing from the scope of the invention, as defined in the appended claims and as described above.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at least some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A stop for stopping a trolley on a rail, the trolley comprising a set of wheels, including a first wheel, the rail providing, at least in part, a running surface, including a first portion and a second portion thereof, for the first wheel, the stop comprising:

an actuator providing a third portion of the running surface between the first portion and the second portion; and an arm, coupled to the actuator;

wherein the stop is arrangeable in:

a first configuration, wherein the arm is arranged to block the trolley therepast; and a second configuration, wherein the arm is arranged to allow the trolley therepast;

wherein the stop is arranged to move from the first configuration to the second configuration by actuation of the actuator by a movement of the actuator in a direction transverse to the third portion of the running surface, wherein the stop comprises a latch, wherein the arm is coupled to the actuator via the latch, and wherein, in the first configuration, the latch is arranged to retain the arm and in the second configuration, the latch is arranged to release the arm.

2. The stop according to claim 1, wherein the movement of the actuator comprises a threshold movement.

3. The stop according to claim 1, wherein the movement of the actuator is due, at least in part, to a force imposed thereupon through the first wheel.

4. The stop according to claim 1, wherein the movement is a linear movement orthogonal to the third portion of the running surface.

5. The stop according to claim 1, comprising a first biasing member arranged to bias the stop in the first configuration.

6. The stop according to claim 1, comprising a second biasing member arranged to bias the actuator against the movement.

7. The stop according to claim 1, wherein the stop comprises a monorail stop.

8. The stop according to claim 1, wherein the stop comprises a suspended rail stop.

9. A stop assembly comprising a stop according to claim 1 and a section of rail for a trolley comprising a set of wheels, including a first wheel, the rail providing, at least in part, a running surface, including a first portion and a second portion thereof, for the first wheel.

10. The stop assembly according to claim 9, wherein the first portion and the second portion of the running surface are transversely thereto mutually offset, wherein:

in the first configuration, the first portion and the third portion of the running surface are mutually aligned, thereby providing a first continuous running surface thereon; and in the second configuration, the second portion and the third portion of the running surface are mutually aligned, thereby providing a second continuous running surface thereon.

11. The stop assembly according to claim 9, wherein the running surface comprises a cylindrical running surface or a part thereof.

12. The stop assembly according to claim 9, wherein the rail comprises a cylindrical tube, wherein the running surface comprises a cylindrical running surface or a part thereof and wherein the rail comprises a flange.

13. A rail track, or a kit of parts for a rail track comprising a stop assembly according to claim 9.

14. A trolley assembly comprising:

a stop assembly according to claim 9; and a trolley comprising a frame, a set of wheels, including a first wheel, rotatably coupled to the frame; and an attachment member, coupled to the frame, for suspension of a load therefrom, in use.

15. A rail track, or a kit of parts for a rail track, comprising a set of rails and a stop according to claim 1.

16. A stop for stopping a trolley on a rail, the trolley comprising a set of wheels, including a first wheel, the rail providing, at least in part, a running surface, including a first portion and a second portion thereof, for the first wheel, the stop comprising:

an actuator providing a third portion of the running surface between the first portion and the second portion;

an arm, coupled to the actuator; and a first biasing member, wherein the stop is arrangeable in:

a first configuration, wherein the arm is arranged to block the trolley therepast; and a second configuration, wherein the arm is arranged to allow the trolley therepast;

wherein the stop is arranged to move from the first configuration to the second configuration by actuation of the actuator by a movement of the actuator in a direction transverse to the third portion of the running surface and the first biasing member is arranged to bias the stop in the first configuration.

17. The stop according to claim 16, further comprising:

a second biasing member arranged to bias the actuator against the movement.

* * * * *